United States Patent [19]

Ronai

[11] 4,035,965

[45] July 19, 1977

[54] COLLAPSIBLE COMBINATION FENCE AND GARAGE STRUCTURE

[76] Inventor: Anne A. Ronai, 1150 Fifth Ave., Flat 15E, New York, N.Y. 10028

[21] Appl. No.: 727,533

[22] Filed: Sept. 28, 1976

Related U.S. Application Data

[63] Continuation of Ser. No. 539,743, Jan. 9, 1975, abandoned.

[51] Int. Cl.[2] ..... E04B 7/16

[52] U.S. Cl. ..... 52/66; 52/68; 52/69; 52/143

[58] Field of Search ..... 52/66–69, 52/64, 143, 70

[56] References Cited

U.S. PATENT DOCUMENTS

| | | | |
|---|---|---|---|
| 131,114 | 9/1872 | O'Brien | 52/69 |
| 1,498,173 | 6/1924 | Kelley | 52/69 |
| 2,019,831 | 11/1935 | Ricardo | 52/64 |
| 2,057,942 | 10/1936 | Fay | 52/70 |
| 2,636,773 | 4/1953 | van Tassel | 52/67 |
| 2,992,709 | 7/1961 | McIntosh | 52/64 |
| 3,589,525 | 6/1971 | Allen | 52/64 |
| 3,739,537 | 6/1973 | Barnes | 52/64 |

FOREIGN PATENT DOCUMENTS

| | | | |
|---|---|---|---|
| 581,860 | 4/1964 | Canada | 52/64 |
| 15,173 | 7/1904 | United Kingdom | 52/64 |
| 20,120 | 9/1911 | United Kingdom | 52/64 |
| 330,609 | 6/1930 | United Kingdom | 52/64 |

*Primary Examiner*—Price C. Faw, Jr.
*Assistant Examiner*—Henry Raduazo
*Attorney, Agent, or Firm*—Cushman, Darby & Cushman

[57] ABSTRACT

A structure which can be easily and readily converted between a solid vertical structure, functioning as a fence, and a structure enclosing a space and fuctioning as a shed, vehicle garage or the like whereby a rear wall engages a pair of parallel rails for effecting movement of the wall along the rails to any desired position. A roof is pivotably connected to the rear wall along the upper edge and a side wall and front wall are pivotably connected to the roof. The other side wall is slidably connected for permitting the enclosure to receive a vehicle or the like.

10 Claims, 10 Drawing Figures

Fig. 3
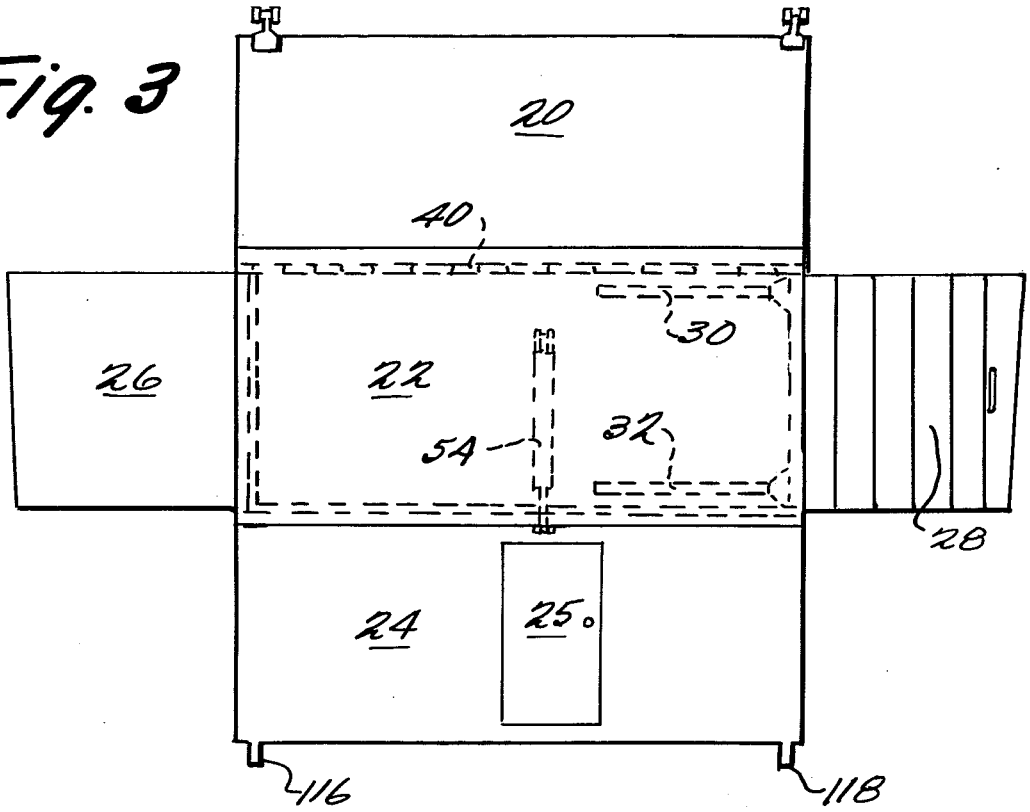
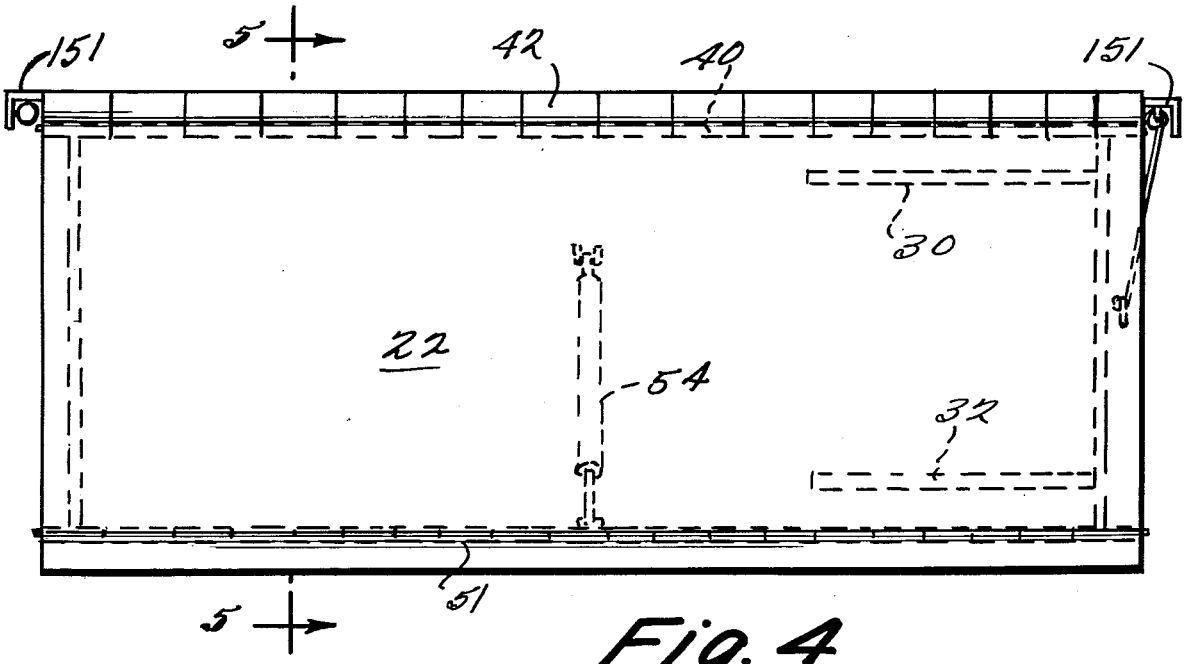
Fig. 4

COLLAPSIBLE COMBINATION FENCE AND GARAGE STRUCTURE

This is a continuation of application Ser. No. 539,743 filed Jan. 9, 1975 and now abandoned.

PRIOR ART AND SUMMARY OF THE INVENTION

This invention relates to a structure which can be easily and readily converted between a solid vertical structure, functioning as a fence, and a structure enclosing a space and functioning as a shed, vehicle garage, or the like.

In view of the increasing scarcity of space for living, it has become increasingly important to utilize a structure which provides the maximum flexibility of use. Often an individual may have a temporary need for a shed to securely store equipment or the like or to house a vehicle. The vehicle may belong to a temporary visitor or it may be simply desirable to provide some protection during adverse weather conditions.

Further, it is often desirable to provide a fence or other similar barriers around a given space. Often the location of such a barrier should be changed to permit use of the space for different purposes.

The present invention relates to a structure which can be used either as a fence or enclosing a space for a temporary garage or storage shed. Further, the structure is preferably mounted on a pair of rails, formed in a plurality of sections, so as to be moveable along the rails to any desired location. Thus, when the structure is assembled as a fence, a solid barrier whose position can be easily and readily changed is provided. The barrier can in a few moments be readily converted into a solid and satisfactory shed.

In one embodiment of the invention of this application as described in detail below, this structure is formed with a rear wall which engages the pair of parallel extending rails for movement along the rails. Each of the rails preferably includes a slot with the rear wall attached to a roller in the slot of each rail for movement therealong. Each of the rail sections preferably is provided with a flap pivotably attached along its side for pivoting to a position convering the slot to protect the slot against dirt or other material being lodged therein and preventing ready movement of the rear wall.

A roof section is pivotably connected along the upper edge of the rear wall and first and second side walls are in turn pivotably connected to the sides of the roof. A front wall is pivotably connected along the edge of the roof opposite the edge pivotably connected to the rear wall. All of the walls and the roof can be easily folded against each other to form a flat and solid barrier with the rear wall and the roof forming the opposite sides of the fence and the front wall and side walls being folded therein.

The roof is preferably provided with an overhang on at least the front and sides thereof for directing as much rain as possible off of the shed and the shed roof is preferably inclined slightly, sufficiently to shed rain and prevent accumulation of water, snow and the like. Means such as an air cylinder or the like is preferably connected between the roof and the front wall for ensuring that the front wall does not pivot downward too quickly during assembly of the unit.

Many other objects and purposes of the invention will be clear from the following detailed description of the drawings.

BRIEF DESCRIPTION OF THE DRAWINGS

FIG. 2 shows a perspective view of the structure of this invention assembled as a shed, vehicle garage or the like.

FIG. 3 shows a top spread out view of the structure of this invention.

FIG. 4 shows a top plan view of the structure of this invention assembled as a shed.

FIG. 8 shows a part of a further embodiment of the invention assembled as a shed, vehicle garage, or the like.

DETAILED DESCRIPTION OF THE DRAWINGS

Figure 2:
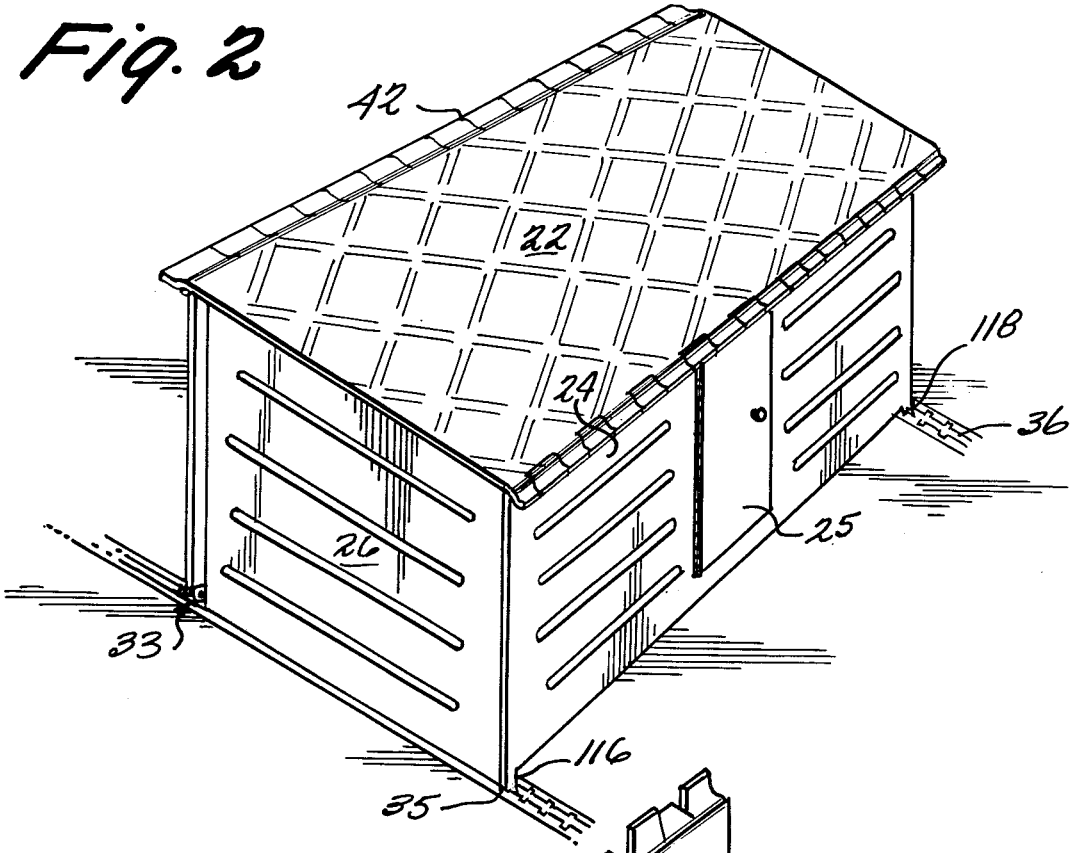
Figure 1:
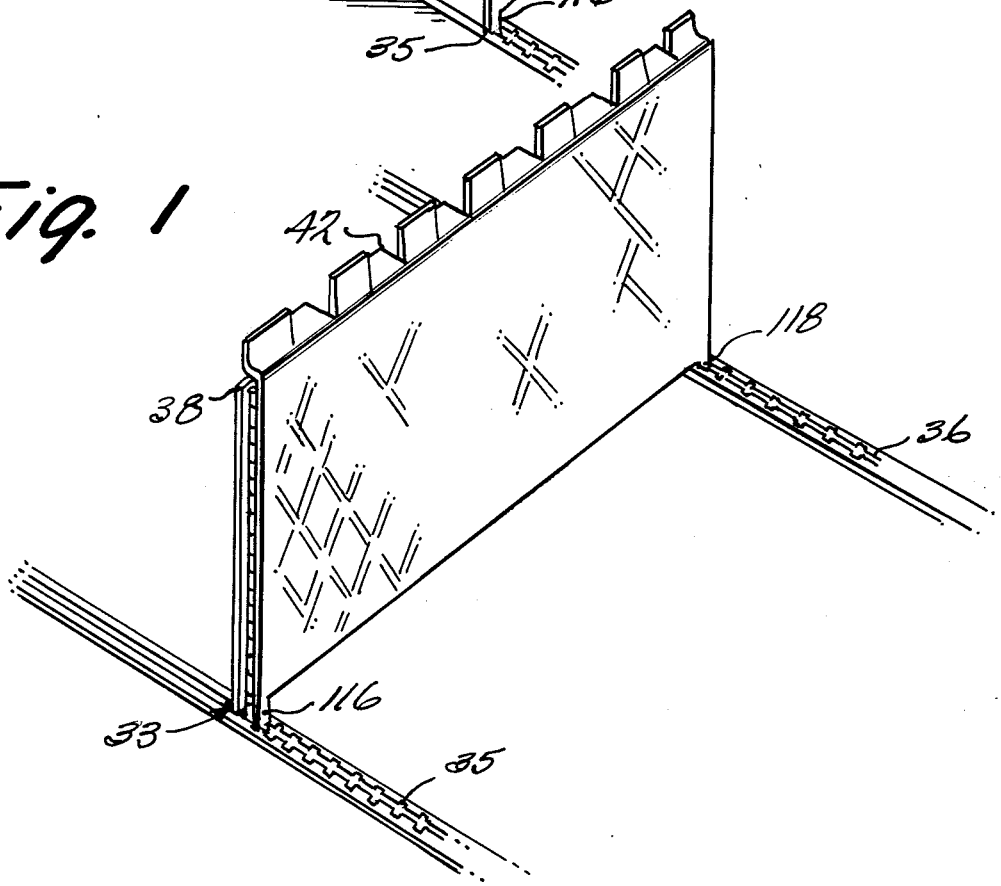
FIG. 1 shows a perspective view of the structure of this invention assembled as a portable fence or barrier.

Reference is now made to FIGS. 1–5 which illustrate one embodiment of the unique invention of this specification. The structure basically includes a rear wall section 20, a roof section 22 pivotably connected at one edge of rear wall section 20, a front wall 24 pivotably connected to the roof section 22 along the edge opposite the pivotably connection of roof section 22 to the rear wall 20, and side walls 26 and 28. Front wall 24 is provided with suitably positioned and secured door 25, and a door can be provided in any wall. Side wall 26 is pivotably connected to an edge of roof 22 as illustrated in, for example, FIG. 3. Wall 28 is connected to the roof 22 so as to be slidable from a position as illustrated in FIG. 1 enclosing the space within the shed to a position extending parallel to roof 20. Side wall 28 slides along rails 30 and 32 provided on the interior surface of roof 22 in conventional fashion to provide an opening for driving a vehicle into the enclosed space.

The walls may be formed of any suitable material such as fiberglass, laminated fiberglass, aluminum, wood, sheet metal, plastics, etc. and may be provided with any suitable ornamental finish such as a brick, stone, wood, etc, embossed, painted or otherwise formed.

Figure 10:
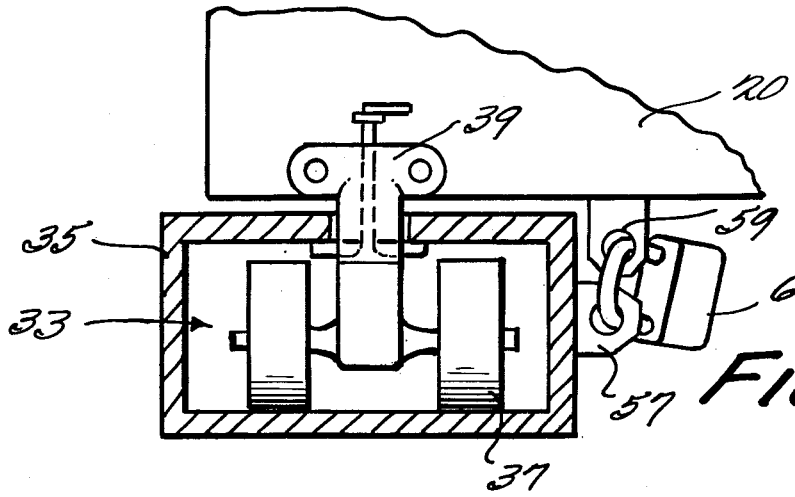
FIG. 10 shows an enlarged fragmentary detail through a rail showing a caster within a rail channel.
Figure 6:
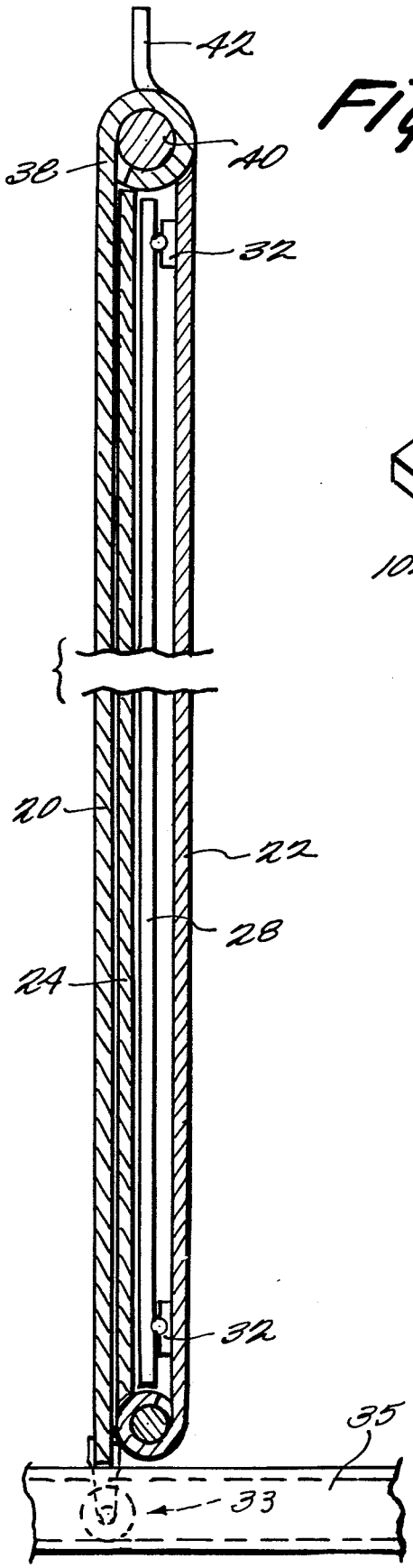
FIG. 6 shows a vertical sectional view through the structure in folded position.

Rear wall 20 includes conventional casters 33 and 34 which are moveable within rails 34 and 36 for moving the rear wall 30, together with the walls and roof attached thereto, along the direction of the rails to permit the barrier to be placed as desired or the shed to be assembled at any desired location. Each caster, as shown in FIG. 10, includes a roller 37 and brake 39. Rails 35 and 36 may be mounted on a platform if desired. Rails 35 and 36 are preferably formed as a plurality of separate sections which can be interconnected as illustrated in FIG. 7 and as described in detail below to form a rail of any given length desired.

Figure 5:
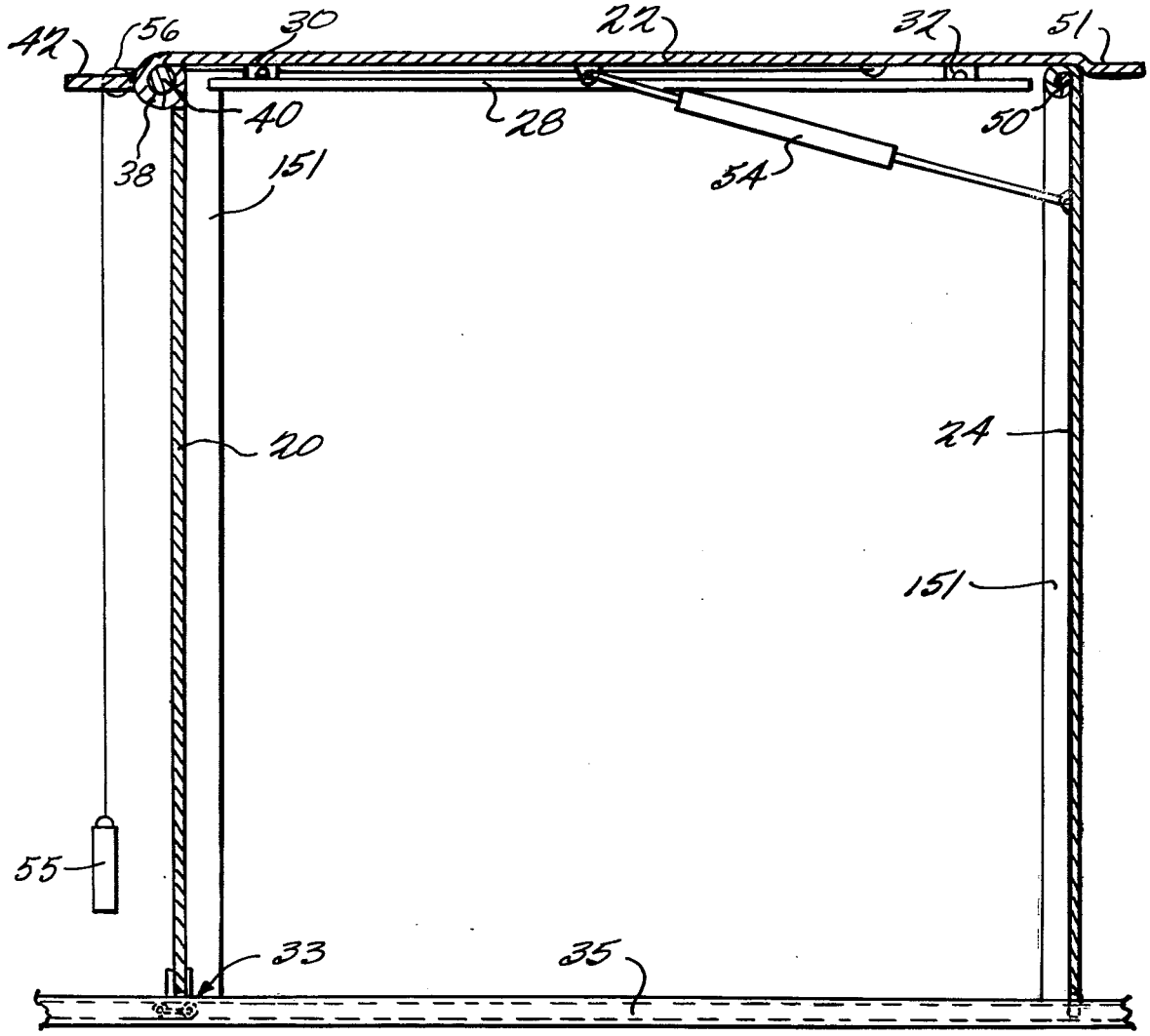
FIG. 5 shows a sectional view along the lines 5—5 in FIG. 4.

Rear wall 20 forms at its upper edge a hinge 38 as can be seen, for example, in FIG. 5. Alternate sections of rear wall 20 and roof 22 are bent in opposite directions to form a hinge as can be seen in FIG. 4 with pin 40 extending between the bent sections to form a pivotable connection between rear wall 20 and roof 22. The unbent sections of rear wall 20 and roof 22 extend outward to form a ledge 42 which serves to convey rain and the like away from the rear wall and to provide a suitable overhang.

The upper part of the front wall 24 is similarly bent as can be seen in FIG. 5 together with alternate sections of roof 22 to form a hinge which is held in place by pin 50. An overhang 51 is also provided. Similarly the upper edge of side wall 26 is alternately bent as illustrated in FIG. 7 as is the adjoining portions of roof 22 to form a hinge which is held in place by a similar pin. Referring to FIGS. 3 and 5, a conventional air cyliner 54 or other similar means is connected between the front wall 24 and the roof 22 to prevent front wall 24 from falling too rapidly and possibly injuring the individual assemblying the unit as a shed. Further, a counterweight 55 is connected via pulley 56, attached to rear wall 20, to roof 22 to aid in pulling the roof from a vertical to horizontal position. Any other mechanism such as a rachet can be alternatively employed.

Figure 7:
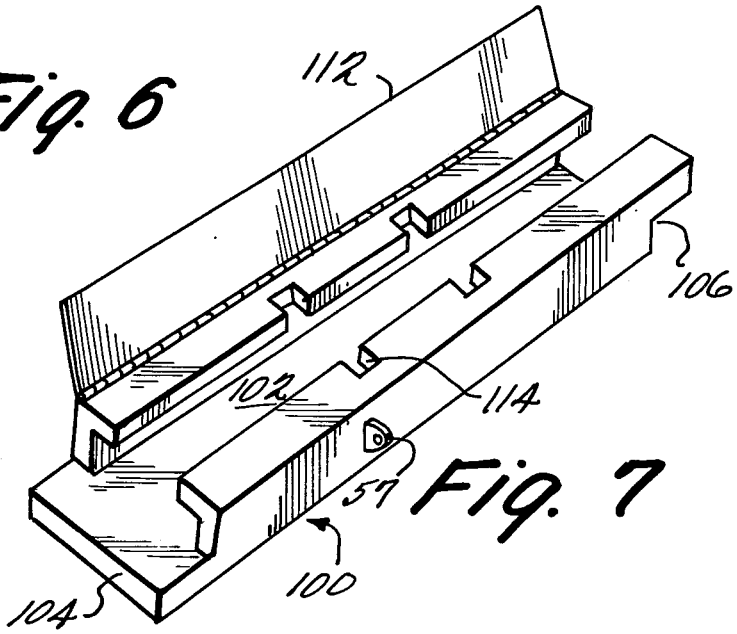
FIG. 7 shows a perspective view of one of the rail sections.

FIG. 7 illustrate one of the sections which form the rails 35 and 36. Section 100 is formed with a slot 102 extending along its length through which the caster mechanism 33 or 34 extends to conventionally permit the end wall 20 and the walls 24, 26 and 28 as shown in FIG. 10 and roof 22 attached to it to be moved along rails 35 and 36. Section 100 is provided with an eye 57 which can be locked to eye 59 on end wall 20 by lock 61. Section 100 includes male portion 104 which engages a mating female portion 106 at the other end as can be seen in FIG. 10. Thus the sections can be easily and quickly snapped into place. Cover 112 is pivotably attached along one side of rail section 100 for permitting the rail section to be covered to prevent the slots 102 from being filled with dirt or the like when a rail section is not being used to move an end wall. Transverse slots 114 are preferably provided at intervals on each of the rails for engaging a forked portions 116 and 118 on the lower edges of the front wall 24 as can be seen, for example, in FIG. 3 for locking the shed firmly in place when assembled.

Heat can be supplied to the channels formed by the rail sections to heat the interior space when the structure is assembled as a shed.

Vertical flaps or cornice 151 cover the sides of the structure when folded as a fence.

Figure 8:
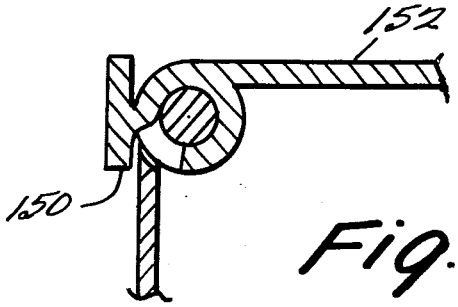
Figure 9:
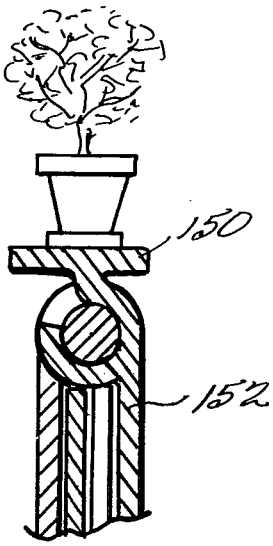
FIG. 9 shows a portion of the further embodiment of FIG. 8 assembled as a fence or barrier.

FIGS. 8 and 9 illustrate a further embodiment of the invention which relates to the shape of the overhang 150 of roof section 152. As illustrated in FIG. 8 and 9, by providing an overhang which extends vertically when the structure is assembled as a shed, the overhang 150 will provide a horizontal surface atop the structure when it is assembled as a fence or barrier which will permit plants or the like to be placed thereon, thus providing greater opportunties for decorative use of the structure.

Many changes and modifications in the above described embodiment of the invention can, of course, be carried out without departing from the scope of that invention. Accordingly, that scope is intended to be limited only by the scope of the appended claims.

What is claimed is:

1. A convertible fence/shed structure comprising:

rail means disposed in an essentially horizontal plane;

a rear wall having top and bottom edges extending transversely of said rail means and defining a vertical plane essentially perpendicular to the rail means; said rear wall being provided with means adjacent its bottom edge and engaging said rail means so that said rear wall can be moved along the length of said rail means while remaining in a plane essentially perpendicular thereto;

a roof having opposed front and rear edges extending transversely of said rail means, said roof being pivotally connected at its rear edge to the upper edge of said rear wall;

a front wall pivotally connected along the front edge of said roof, and side walls operatively connected to said roof, front wall and rear wall so that said side walls, front wall and roof can be pivoted and folded together into a vertically stacked position whereby said side and front walls and roof extend roughly parallel to said rear wall to form with said rear wall a fence which extends transversely of said rail means with the rear wall and roof constituting opposite sides of the fence and which can be positioned at any point along said rail means and said side walls, front wall and roof can be pivoted from said folded position into a position where said side walls and roof extend outwardly from and transversely to said rear wall and to each other and said front wall extends parallel to said rear wall and transversely to said roof and side walls to form an enclosed shed defined by said side walls, front and rear walls and roof.

2. A structure as in claim 11 wherein said roof has a portion extending beyond the pivotable connection of said roof to said rear wall and the pivotable connection to said front wall.

3. A structure as in claim 1 wherein said rail means comprises a pair of rails formed in a plurality of sections each including a flap pivotally connected along one side thereof for pivoting to a position covering the rail slot.

4. A structure as in claim 3 wherein each said rail has a male portion at one end and a female portion at the other end.

5. A structure as in claim 1 wherein said roof has an extended portion along its rear edge to provide a horizontal platform when said structure is folded to form a fence.

6. A structure as in claim 1 wherein said roof is inclined to the horizontal when forming an enclosed space.

7. A structure as in claim 1 further including means connected between said rear wall and roof for aiding movement of said roof from a vertical into a horizontal position.

8. A structure as in claim 7 wherein said holding means includes a counterweight.

9. A structure as in claim 7 further including means connected between said front wall and roof for slowing movement of said front wall to a vertical position after said roof is in a horizontal position.

10. A structure as in claim 9 wherein said slowing means includes an air cylinder.

* * * * *